US005131255A

United States Patent [19]

Fushiya et al.

[11] Patent Number: 5,131,255

[45] Date of Patent: Jul. 21, 1992

[54] POWER DRIVEN TOOL

[75] Inventors: Fusao Fushiya; Shigeki Yamauchi; Hideki Tanaka, All of Anjo, Japan

[73] Assignee: Makita Corporation, Anjo, Japan

[21] Appl. No.: 729,147

[22] Filed: Jul. 12, 1991

[30] Foreign Application Priority Data

Jul. 13, 1990 [JP] Japan ..... 2-186819

[51] Int. Cl.[5] ..... B21J 15/16; B21J 15/26

[52] U.S. Cl. ..... 72/391.8; 72/114; 29/243.526

[58] Field of Search ..... 72/114, 391.2, 391.4, 72/391.8, 454; 29/243.521, 243.522, 243.526, 243.529

[56] References Cited

U.S. PATENT DOCUMENTS

| | | | |
|---|---|---|---|
| 2,437,191 | 3/1948 | Gill | 72/114 |
| 3,029,665 | 4/1962 | Baugh et al. | 72/402 |
| 3,197,987 | 10/1965 | Martin | 72/114 |
| 3,686,915 | 8/1972 | Miller et al. | 72/391.8 |
| 4,074,554 | 2/1978 | Summerlin | 72/391.8 |
| 4,321,814 | 3/1982 | Martin | 72/114 |
| 4,574,612 | 3/1986 | Tanikawa | 72/391.8 |

FOREIGN PATENT DOCUMENTS

| | | | |
|---|---|---|---|
| 0213101 | 3/1987 | European Pat. Off. | 29/243.56 |
| 49-14033 | 4/1974 | Japan . | |
| 55-27335 | 2/1980 | Japan . | |

*Primary Examiner*—David Jones

*Attorney, Agent, or Firm*—Dennison, Meserole, Pollack & Scheiner

[57] ABSTRACT

A power driven tool for crimping a collar fitted on a shank of a rivet inlcudes an outer sleeve mounted on a body and having a portion for press fitting on an outer surface of the collar, and an inner sleeve disposed within the outer sleeve and reciprocally movable in an axial direction. The inner sleeve has a chuck for grasping the shank of the rivet. A drive shaft is threadably inserted within the inner sleeve and is driven by a motor in one direction or the other. A cam mechanism is disposed between the outer sleeve and the inner sleeve and includes a cam pin mounted on the outer sleeve, and a recess formed on the inner sleeve for engagement with the cam pin so as to prevent rotation of the inner sleeve relative to the outer sleeve. The recess includes a first relief portion and a second relief portion at both ends in an axial direction which permit rotation of the inner sleeve only in one direction and only in the other direction, respectively.

9 Claims, 5 Drawing Sheets

POWER DRIVEN TOOL

BACKGROUND OF THE INVENTION

1. Field of the Invention

The present invention relates to a power driven tool and particularly to a power driven tool for crimping a collar which is fitted on a shank of a rivet for fastening a work.

2. Description of the Prior Art

A conventional power driven tool of the above-mentioned type includes an inner sleeve having a chuck for grasping a shank of a rivet, an outer sleeve coaxially disposed with the inner sleeve and having a crimping member for crimping a collar, and a motor for driving the inner sleeve. In operation, the shank of the rivet is inserted into a work to be fastened and thereafter a collar is fitted on the shank of the rivet. The end portion of the shank is grasped by the chuck of the inner sleeve and the inner sleeve is moved in an axial direction to pull the rivet. Then, the crimping member is forced to be fitted on the collar, so that the collar is crimped and fastened on the shank, and thereafter, a part of the shank of the rivet is cut by the crimping member.

The inner sleeve is reciprocally moved by the motor in such a manner that it moves rearwardly to pull the shank of the rivet while it moves forwardly to restore its position for engagement of the chuck with the shank. Various mechanisms have been proposed heretofore to convert the rotation of the motor into liner reciprocal movement.

Japanese Patent Publication No. 49-14033 discloses a power driven tool having a hydraulic piston-cylinder mechanism for moving an inner sleeve. This mechanism, however, requires a relatively long fluid pipe, a gear pump and various valve means, etc. The power driven tool having this mechanism tends to become large and weighty, and therefore, it cannot be effectively operated.

U.S. Pat. No. 3,029,665 discloses a power driven tool having a fork which is connected with an inner sleeve and is swung around a pivot. With this mechanism, the fork has to be relatively long, and therefore, the power driven tool tends to become large.

Japanese Utility Model Publication No. 55-37335 discloses a power driven tool having a ball screw mechanism for moving an inner sleeve. The ball screw mechanism includes a threaded shaft driven by a motor through harmonic gear means and a threaded portion formed on the inner surface of the inner sleeve for engagement with the threaded shaft through a plurality of balls. With such construction, the inner sleeve is moved forwardly when the motor is rotated in one direction, while it is moved rearwardly when the motor is rotated in another direction. An operational rod and a proximity switch are provided to change the change the direction of rotation of the motor. The operational rod extends outwardly from a gear case accommodating the harmonic gear means and moves together with the inner sleeve. The proximity switch detects the end of the operational rod and outputs a control signal of the motor for firstly stopping the rotation of the motor and for thereafter starting the motor for rotation in another direction. The ball screw mechanism is relatively compact and lightweight as compared with the above-mentioned hydraulic piston-cylinder mechanism or the swinging fork mechanism. However, since the direction of rotation of the motor is changed by the operational rod and the proximity switch, the motor may further rotate by an inertia force even after it has been stopped by the control signal. This may consequently cause excessive movement of the inner sleeve in the forward or rearward direction from the stroke ends defined by the position of the proximity switch. Therefore, it requires to determine the position of the proximity switch in consideration of the excessive movement of the inner sleeve after the motor has been stopped. Such positioning of the proximity switch cannot be reliably made and therefore, the stroke ends of the inner sleeve cannot be accurately positioned. Additionally, since the operational rod extends in an axial direction and moves together with the inner sleeve, the whole tool requires to be relatively long, so that the operation of the power driven tool cannot be reliably performed.

SUMMARY OF THE INVENTION

It is, accordingly, an object of the present invention to provide a power driven tool in which the direction of movement of an inner sleeve can be reliably changed at predetermined stroke ends.

It is another object of the present invention to provide a power driven tool which is relatively short in length.

According to the present invention, there is provided a power driven tool for crimping a collar fitted on a shank of a rivet comprising:

- a body;
- an outer sleeve mounted on the body and having at the forward end thereof a portion for press fitting on an outer surface of the collar;
- an inner sleeve disposed within the outer sleeve and reciprocally movable in an axial direction;
- a chuck mounted on the forward end of the inner sleeve for grasping the shank of the rivet;
- a drive shaft threadably inserted within the inner sleeve;
- a motor disposed within the body for rotation of the drive shaft in one direction or the other; and
- a cam mechanism disposed between the outer sleeve and the inner sleeve, the cam mechanism including a cam pin mounted non-rotatably on one of the outer sleeve and the inner sleeve, and a recess formed on the other of the outer sleeve and the inner sleeve for engagement with the cam pin so as to prevent rotation of the inner sleeve relative to the outer sleeve, the recess including a first relief portion and a second relief portion at both ends in an axial direction which permit rotation of the inner sleeve only in one direction and only in another direction, respectively.

Preferably, the cam pin may be mounted on the outer sleeve and the recess may be formed on the outer surface of the inner sleeve.

The recess includes a first linear portion and a second linear portion disposed in parallel to each other in an axial direction of the inner sleeve. The first and second linear portions are joined to each other at the first and second relief portions and engage the cam pin for movement of the inner sleeve rearwardly and forwardly, respectively.

Each of the first and second linear portions extends in an axial direction of the inner sleeve and includes a side surface extending substantially in a radial direction for contacting the lateral surface of the cam pin and a bottom surface extending substantially perpendicular to the side surface. The side surface of the first linear portion and that of the second linear portion are apart from each other in a circumferential direction of the inner surface at a predetermined distance.

Each of the first and second relief portions includes a first surface and a second surface. The first surface is joined to one of the bottom surfaces of the first and second linear portions in the same plane therewith. One end of the first surface in a cricumferential direction is smoothly connected with the outer surface of the inner sleeve. The second surface is formed between the first surface and the other of the bottom surfaces so as to facilitate transfer of the cam pin from the other of the bottom surfaces to the first surface.

The cam pin may be forced in a radial direction toward the recess by bias means such as a leaf spring mounted on the inner sleeve.

The cam mechanism comprises two cam mechanisms opposed to each other in a diametrical direction of the inner sleeve.

The invention will become more fully apparent from the claims and the description as it proceeds in connection with the drawings.

DETAILED DESCRIPTION OF THE PREFERRED EMBODIMENT

Figure 1:
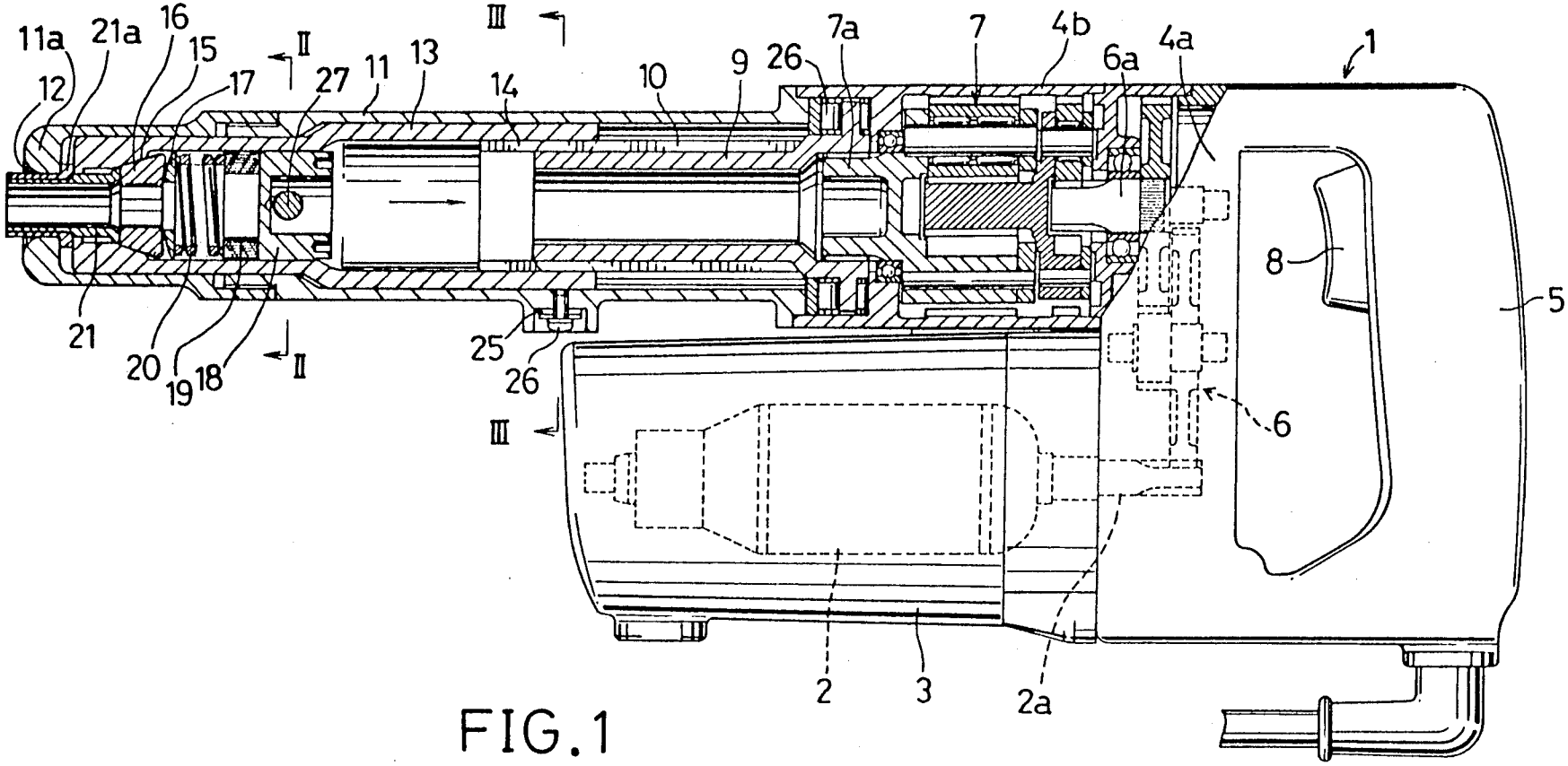
FIG. 1 is a side view, with a portion broken away, of a power drive tool according to an embodiment of the present invention.

Referring to FIG. 1, there is shown a power driven tool according to an embodiment of the present invention. The power driven tool includes a body 1 having a motor housing 3 accommodating a motor 2 for rotation in both forward and reverse directions, a first gear housing 4*a* disposed adjacent the rear end of the motor housing 3 and extends upwardly therefrom, a second gear housing 4*b* disposed above the motor housing 3 in parallel thereto and connected with the upper portion of the first gear housing 4*a* at the front side thereof, and a handle housing 5 of substantially inverted C-shaped configuration and disposed adjacent the rear end of the first gear housing 4*a*. A motor shaft 2*a* of the motor 2 extends into the first gear housing 4*a* and is connected with a first reduction gear mechanism 6. An output shaft 6*a* of the first reduction gear mechanism 6 is connected with a second reduction gear mechanism 7 such as a planetary gear mechanism disposed within the second gear housing 4*b*. An output shaft 7*a* of the second reduction gear mechanism 7 extends in parallel to the motor shaft 2*a* of the motor 2. A switch 8 is mounted on the handle housing 5 for starting and changing the direction of rotation of the motor 2.

A cylindrical drive shaft 9 is disposed coaxially with the output shaft 7*a* of the second reduction gear mechanism 7 and is fitted on the output shaft 7*a* through a key or like means. The drive shaft 9 is rotatably supported by the second gear housing 4*b* through a thrust bearing 26. A threaded portion 10 is formed on the outer surface of the drive shaft 9.

A cylindrical outer sleeve 11 is fixed to the second gear housing 4*b* in such a manner that is rear end portion surrounds the drive shaft 9 in a spaced relation thereto at a predetermined distance. The outer sleeve 11 extends forwardly beyond the drive shaft 9 and includes an inwardly flange portion 11*a* at the forward end thereof. The flanged portion 11*a* has a collar-receiving portion 12 formed to have a diameter gradually increasing in a forward direction for fitting on a collar and thereafter crimping the same.

Figure 2:
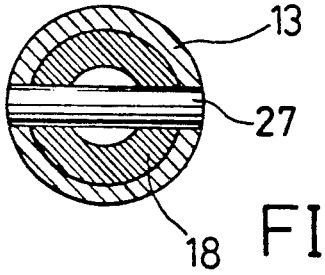
FIG. 2 is a sectional view taken along line II—II in FIG. 1.
Figure 3:
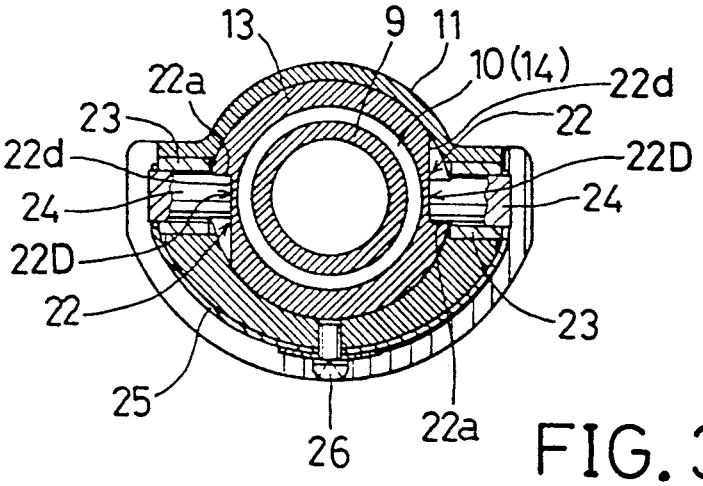
FIG. 3 is a sectional view taken along line III—III in FIG. 1.
Figure 4:
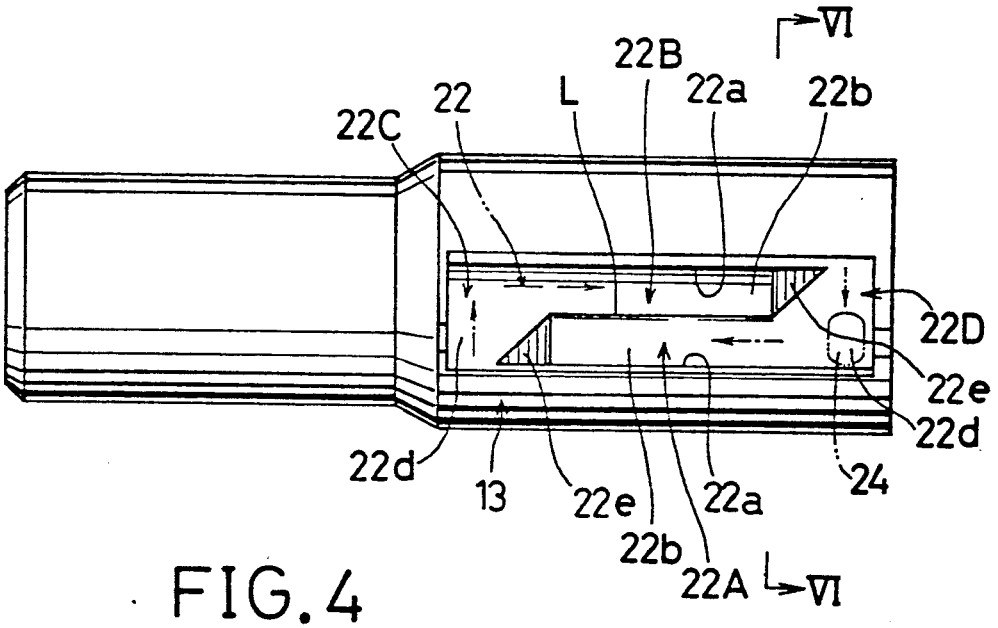
FIG. 4 is a side view of an inner sleeve shown in FIG. 1.
Figure 5:
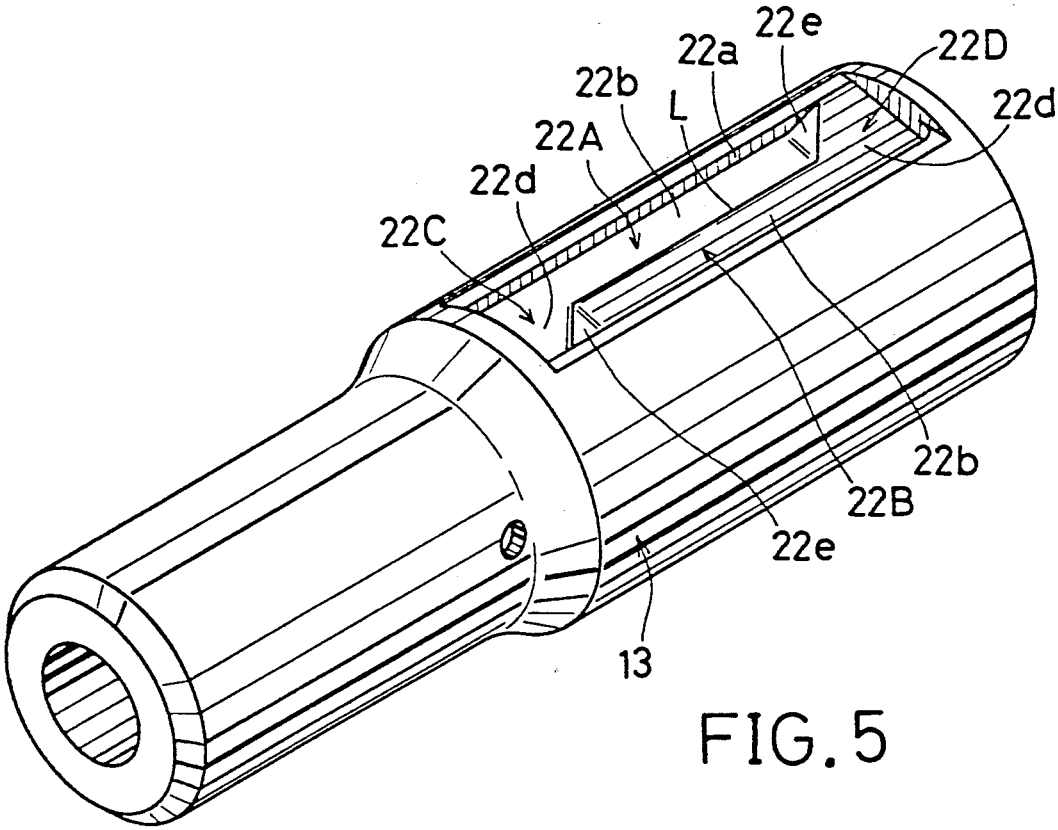
FIG. 5 is a perspective view of the inner sleeve.
Figure 6:
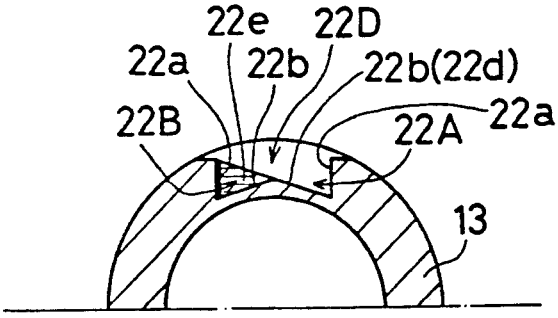
FIG. 6 is a partially cutaway sectional view taken along line VI—VI in FIG. 4.

A cylindrical inner sleeve 13 is slidably inserted into the outer sleeve 11 in such a manner that the inner sleeve 13 is movable in an axial direction relative to the outer sleeve 11 within a predetermined range and is rotatable relative to the outer sleeve 11. A threaded portion 14 is formed on the inner surface of the rear portion of the inner sleeve 13 within a predetermined range in an axial direction. The threaded portion 14 normally engages the threaded portion 10 of the drive shaft 9. The forward portion of the inner surface of the inner sleeve 13 is formed with a conical surface 15. The conical surface 15 receives a chuck 16 for grasping the shank of the rivet. The chuck 16 changes its inner diameter in cooperation with the conical surface 15. The inner surface of the chuck 16 is formed with a plurality of annular protrusions for engagement with corresponding annular grooves formed on the shank of the rivet. The chuck 16 is normally urged forwardly by a compression spring 20 interposed between the chuck 16 and a stopper member 18 fixed within the inner sleeve 13 through a pin 27 as shown in FIG. 2, so that the outer surface of the chuck 16 is pressed on the conical surface 15. A spring support ring 17 is disposed between the chuck 16 and the forward end of the spring 20 while a damper member 19 such as a rubber ring is disposed between the rear end of the spring 20 and the stopper member 18. A cylindrical abutting member 21 is fitted within the forward end of the inner sleeve 13 and is provided with an outwardly flanged portion 21*a* at the middle position in a longitudinal direction. The rear end of the abutting member 21 abuts on the forward end of the chuck 15 while the flanged portion 21*a* abuts on the end surface of the inner sleeve 13. Thus, when the inner sleeve 13 is positioned at a forward stroke end as shown in FIG. 1, the abutting member 21 extends outwardly from the end surface of the outer sleeve 11 at a slight distance, while a space is formed between the stopper member 18 and the drive shaft 9 for allowing movement of the inner sleeve 13. As shown in FIGS. 3 to 7, a pair of recesses 22 are formed on the outer surface of the inner sleeve 13 within a range from the rear end of the inner sleeve 13 to the middle portion thereof. The recesses 22 are diametrically opposed to each other and cooperate with corresponding cam pins 24 mounted on the outer sleeve 11 as shown in FIG. 3 to form cam mechanisms, respectively. Each of the recesses 22 includes a first linear portion 22A for rearward movement of the inner sleeve 13 and a second linear portion 22B for forward movement of the inner sleeve 13. The first linear portion 22A and the second linear portion 22B are juxtaposed with each other and extends in an axial direction of the inner sleeve 13. Each of the first linear portion 22A and the second linear portion 22B includes a side surface 22*a* and a bottom surface 22*b*. The side surface 22*a* extends in a radial direction of the inner sleeve 13 for contacting the lateral surface of the corresponding cam pin 24. The upper edge of the side surface 22*a* is chamfered. The bottom surface 22*b* extends perpendicular to the side surface 22*a* for contacting the end surface of the corresponding cam pin 24. The side surfaces 22*a* of the first and second linear portions 22A and 22B are apart from each other in a circumferential direction of the inner sleeve 13 at a predetermined distance, so that the bottom surfaces 22*b* intersect to form a ridge line L therebetween. The recess 22 further includes a first relief potion 22C and a second relief portion 22D at both ends in an axial direction. Each of the first and second relief portions 22C, 22D includes a first surface 22*d* and a second surface 22*e*.

The configuration of the first and second surfaces 22*d* and 22*e* will be hereinafter explained in connection with the first relief portion 22C for the first linear portion 22A. The first surface 22*d* of the first relief portion 22C is joined to the bottom surface 22*b* of the second linear portion 22B in the same plane. One end of the first surface 22*d* in a circumferential direction of the inner sleeve 13 is smoothly connected with the outer surface of the inner sleeve 13. The other end of the first surface 22*d* is defined by the side surface 22*a* of the second linear portion 22B. The second surface 22*e* is formed between the first surface 22*d* and the bottom surface 22*b* of the fist linear portion 22A and is inclined upwardly toward the first surface 22*d*, so that the transferring movement of the corresponding cam pin 24 from the bottom surface 22*b* of the first linear portion 22A to the first surface 22*d* can be facilitated.

The relation between the first relief portion 22C and the first linear portion 22A as described above is also applicable to the relation between the second relief portion 22D and the second linear portion 22B.

Figure 7:
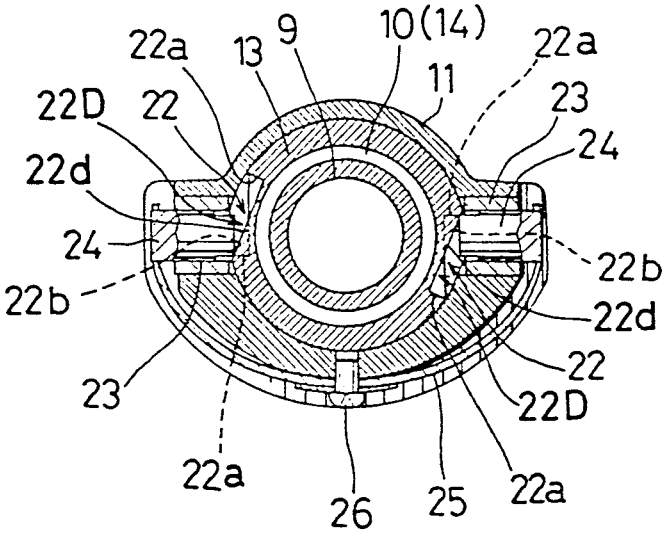
FIG. 7 is a sectional view similar to FIG. 3 but showing the different operational position of the cam mechanism.

As shown in FIGS. 3 and 7, at different operational positions, respectively, the cam pins 24 are disposed in diametrically opposed relation to each other and are radially slidably inserted within guide rings 23, respectively, which are fitted into the outer sleeve 11. The outer end of each of the cam pins 24 extends slightly outwardly from the outer surface of the outer sleeve 11. The outer end of one of the cam pins 24 is connected with one end of a leaf spring 25 disposed along the outer surface of the outer sleeve 11, while the outer end of the other of the cam pins 24 is connected with the other end of the leaf spring 25, so that both the cam pins 24 are normally urged toward the corresponding recesses 22 of the inner sleeve 13. The central portion of the leaf spring 25 is fixed to the outer surface of the outer sleeve 11 through a screw 26, so that an effective spring force can be applied to the cam pins 24. The position of each of the cam pins 24 is so determined that it is positioned at the first surface 24 of the second relief portion 22D adjacent the side surface 22*a* or the rear end of the first linear portion 22A when the inner sleeve 13 reaches the forward stroke end.

The operation of the above embodiment will be hereinafter explained with reference to FIGS. 8 and 9.

Figure 8:
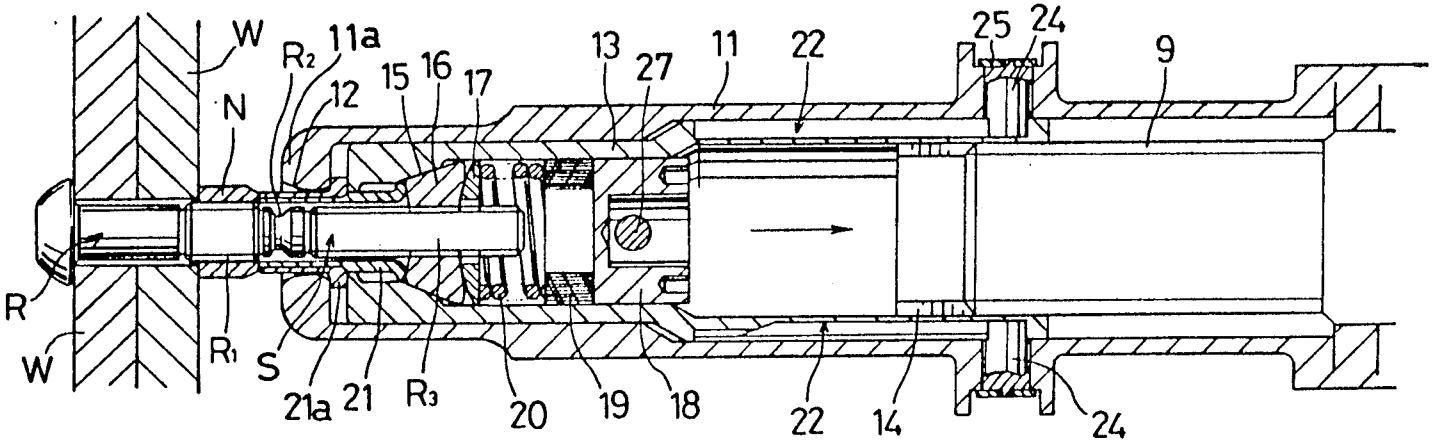
FIGS. 8 and 9 are partly enlarged views of FIG. 1 with a rivet and a collar for fastening works at different operational positions, respectively.
Figure 9:
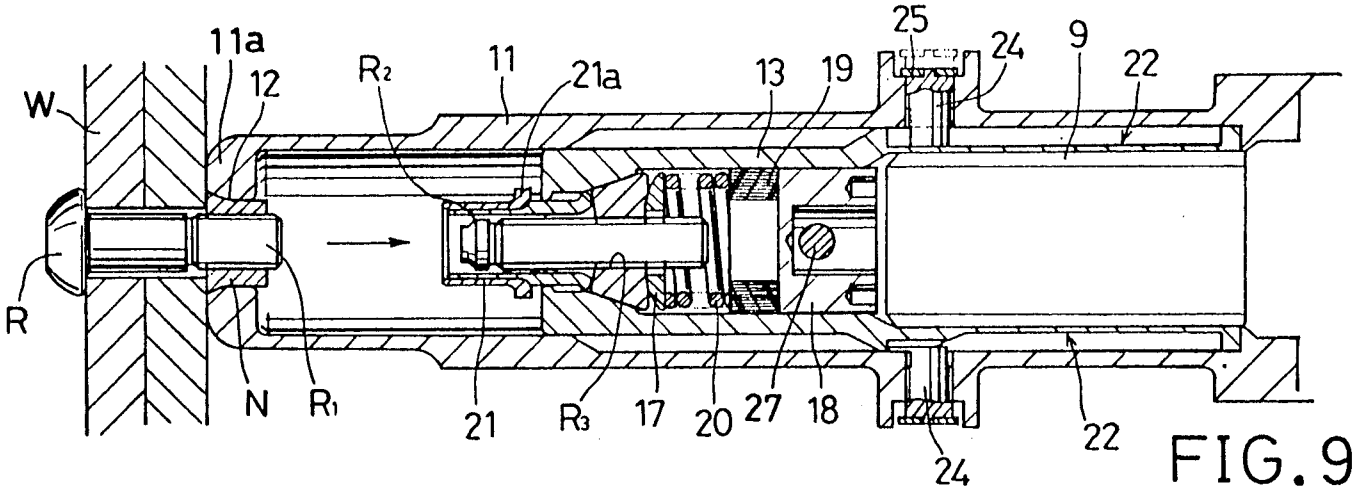

As shown in FIG. 8, the shank S of a rivet R includes a threaded portion R1 on which a collar N is to be crimped, a grooved portion R2 positioned at the rear end of the threaded portion R1 so as to be cut, and a grip portion R3 formed with a plurality of annular grooves. The collar N is firstly threadably engaged with the threaded portion R1 so as to be fitted thereon and is thereafter crimped as will be hereinafter explained.

Prior to operation of the power driven tool, the shank S of the rivet R is firstly inserted into corresponding holes formed in two adjacent plate-like works W and the collar N is engaged with the threaded portion R1. The operator of the power driven tool thereafter moves the body 1 to insert the grooved portion R2 and the grip portion R3 of the shank S into the abutting member 21 on the rear end of the collar N. The switch 8 is then turned on for driving the motor 2 in a forward direction. The rotation of the motor shaft 2*a* of the motor 2 is transmitted to the drive shaft 9 through the first reduction gears 6, the second reduction gears 7 and the output shaft 7*a*, so that the drive shaft 9 rotates in a right-hand or forward direction. The inner sleeve 13 is threadably engaged with the threaded portion 10 of the drive shaft 9 and is rotated with the drive shaft 9 when it is free to rotate. In the state shown in FIG. 8, the inner sleeve 13 is positioned at its forward stroke end, and the position of each of the cam pins 24 is so determined that each of the cam pins 24 is positioned at the first surface 22*d* of the second relief portion 22D adjacent the end surface 22*a* or the rear end of the first linear portion 22A when the inner sleeve 13 reaches the forward stroke end as previously described. Therefore, in case the threaded portion 10 is a right-hand thread, the rotation of the inner sleeve 13 may be prevented by the engagement of the cam pins 24 with the corresponding side surfaces 22*a*, so that the inner sleeve 13 moves rearwardly through engagement with the threaded portion 10 of the drive shaft 9 with the side surfaces 22*a* guided by the corresponding cam pins 24. With such rearward movement of the inner sleeve 13, the conical inner surface 15 of the forward portion of the inner sleeve 13 is pressed on the chuck 16 so as to close at the first stage, so that the grip portion R3 of the shank S of the rivet R is fixedly grasped by the chuck 16 through engagement of the inner surface of the chuck 16 with the annular grooves of the grip portion R3. In this stage a small clearance is produced between the forward end of the inner sleeve 13 and the flanged portion 21*a* of the abutting member 21.

The inner sleeve 13 is further moved rearwardly with the grip portion R3 of the rivet R grasped by the chuck 16 so as to pull the shank S in the same direction. Since the tool is still kept to be pressed toward the rivet R, the outer sleeve 11 is moved forwardly relative to the inner sleeve 13. Then, the collar-receiving portion 12 or the inner surface of the forward end of the inner sleeve 13 is forced to be fitted on the outer surface of the collar N so that the collar N is pressed on the corresponding work W and is subsequently crimped by the collar receiving portion 12.

The inner sleeve 13 is subsequently moved to pull the shank S of the rivet R with the grip portion R3 grasped by the chuck 16 and the collar N is further firmly crimped by the collar-receiving portion 12. The grip portion R3 is consequently separated from the threaded portion R1 since the grooved portion R2 is cut by the pulling force while the collar N is firmly fixed to the threaded portion R1 as shown in FIG. 9.

When the grooved portion R2 is cut, the reaction force may be applied to the inner sleeve 13. However, such reaction force may be absorbed by the spring 20 and the damper member 19, so that the influence of the reaction force on the inner sleeve 13 can be reduced.

As the inner sleeve 13 moves rearwardly, each of the cam pins 24 reaches the second surface 22*e* of the first relief portion 22C and is gradually moved outwardly in a radial direction against the force of the leaf spring 25 so as to subsequently reach the first surface 22*d* where the inner sleeve 13 is free to rotate in a forward direction.

The inner sleeve 13 therefore rotates with the drive shaft 9 to terminate its rearward movement. Then, the switch 8 is turned to drive the motor 2 in a reverse direction, and the drive shaft 9 is rotated in a left-hand direction, so that the inner sleeve 13 rotates with the drive shaft 9 in the same direction until the side surface 22*a* engages the corresponding cam pin 24.

The inner sleeve 13 is thus prevented from rotating in a left-hand direction, so that the inner sleeve 13 moves forwardly with each of the side surfaces 22*a* of the second linear portions 22B guided by the corresponding cam pin 24 while the separated grip portion R3 of the rivet R is kept to be grasped by the chuck 16 of the inner sleeves 13.

As the inner sleeve 13 further moves forwardly, the abutting member 21 abuts on the rear end of the crimped collar N, so that the outer sleeve 11 which has been pressed toward the collar N is moved rearwardly relative to the inner sleeve 13. The collar-receiving portion 12 of the forward end of the outer sleeve 11 is consequently released from engagement with the collar N, and the forward end of the inner sleeve 13 abuts on the flanged portion 21*a* of the abutting member 21 to permit expansion of the chuck 16. The grip portion R3 is thus released from engagement with the chuck 16.

In this stage, each of the cam pins 24 reaches the second surface 22*e* of the first relief portion 22D and is gradually moved outwardly in a radial direction against the force of the leaf spring 25 so as to subsequently reach the first surface 22*d* where the inner sleeve 13 is free to rotate in a left-hand or reverse direction.

The inner sleeve 13 therefore rotates with the drive shaft 9 to terminate its forward movement. Then, the switch 8 is turned to a neutral position to stop the motor 2. The separated grip portion R3 is thereafter removed from the chuck 16. Thus, one cycle of fastening operation of the collar N to the rivet R is completed.

While the invention has been described with reference to a preferred embodiment thereof, it is to be understood that modifications or variations may be easily made without departing from the scope of the present invention which is defined by the appended claims.

What is claimed is:

1. A power driven tool for crimping a collar fitted on a shank of a rivet comprising:

a body;

an outer sleeve mounted on said body and having at the forward end thereof a portion for press fitting on an outer surface of the collar;

an inner sleeve disposed within said outer sleeve and reciprocally movable in an axial direction;

a chuck mounted on the forward end of said inner sleeve for grasping the shank of the rivet;

a drive shaft threadably inserted within said inner sleeve;

a motor disposed within said body for rotation of the drive shaft in one direction or the other; and a cam mechanism disposed between said outer sleeve and said inner sleeve, said cam mechanism including a cam pin mounted non-rotatably on one of the outer sleeve and the inner sleeve, and a recess formed on the other of said outer sleeve and said inner sleeve for engagement with the cam pin so as to prevent rotation of said inner sleeve relative to said outer sleeve, said recess including a first relief portion and a second relief portion at both ends in an axial direction which permit rotation of said inner sleeve only in one direction and only in the other direction, respectively.

2. The power driven tool as defined in claim 1 wherein said cam pin is mounted on said outer sleeve and said recess is formed on the outer surface of said inner sleeve.

3. The power driven tool as defined in claim 1 wherein said recess includes a first linear portion and a second linear portion disposed in parallel to each other in an axial direction of the other of said outer sleeve and said inner sleeve, said first and second liner portions being jointed to each other at said first and second relief portions and engaging said cam pin for movement of the inner sleeve rearwardly and forwardly, respectively.

4. The power driven tool as defined in claim 3 wherein each of said first and second linear portions extends in an axial direction of said inner sleeve and includes a side surface extending substantially in a radial direction for contacting the lateral surface of said cam pin and a bottom surface extending substantially perpendicular to said side surface, said side surface of said first linear portion and that of said second linear portion being apart from each other in a circumferential direction of said inner surface at a predetermined distance.

5. The power driven tool as defined in claim 3 wherein each of said first and second relief portions includes a first surface joined to one of said bottom surfaces of said first and second linear portions in the same plane therewith, one end of said first surface in a circumferential direction being smoothly connected with the outer surface of said inner sleeve, and a second surface formed between said first surface and the other of said bottom surfaces so as to facilitate transfer of said cam pin from the other of said bottom surfaces to said first surface.

6. The power driven tool as defined in claim 5 wherein the upper edges of said side surfaces of said first and second linear portions are positioned at substantially the same level with the upper edges of corresponding said first and second relief portions, respectively.

7. The power driven tool as defined in claim 1 wherein said cam pin is forced in a radial direction toward said recess by bias means.

8. The power driven tool as defined in claim 7 wherein said bias means comprises a leaf spring mounted on said inner sleeve.

9. The power driven tool as defined in claim 1 wherein said cam mechanism comprises two cam mechanisms opposed to each other in a diametrical direction of said inner sleeve.

* * * * *